US009739477B2

(12) United States Patent
Akinaga et al.

(10) Patent No.: US 9,739,477 B2
(45) Date of Patent: Aug. 22, 2017

(54) DRAINAGE COLLECTION SYSTEM

(75) Inventors: Sohei Akinaga, Matsuyama (JP); Hiroyuki Hatanaka, Matsuyama (JP); Koji Nagai, Matsuyama (JP); Tomohiro Ookubo, Matsuyama (JP); Tetsuji Namato, Matsuyama (JP)

(73) Assignee: MIURA CO., LTD., Matsuyama-Shi, Ehime (JP)

( * ) Notice: Subject to any disclaimer, the term of this patent is extended or adjusted under 35 U.S.C. 154(b) by 25 days.

(21) Appl. No.: 14/365,590

(22) PCT Filed: Apr. 27, 2012

(86) PCT No.: PCT/JP2012/061377

§ 371 (c)(1),
(2), (4) Date: Jun. 13, 2014

(87) PCT Pub. No.: WO2013/088757

PCT Pub. Date: Jun. 20, 2013

(65) Prior Publication Data

US 2014/0338615 A1 Nov. 20, 2014

(30) Foreign Application Priority Data

Dec. 15, 2011 (JP) ..... 2011-274131

(51) Int. Cl.
*F22D 5/30* (2006.01)
*F22D 11/06* (2006.01)
(Continued)

(52) U.S. Cl.
CPC ..... *F22D 11/06* (2013.01); *F01K 5/02* (2013.01); *F22B 33/10* (2013.01); *F22B 35/00* (2013.01);
(Continued)

(58) Field of Classification Search
CPC ..... F22D 11/06; F22D 5/00
(Continued)

(56) References Cited

U.S. PATENT DOCUMENTS 100,883 A * 3/1870 Goldman ..... F22D 11/06 417/107
3,116,876 A * 1/1964 Palm ..... F24D 3/04 122/251

(Continued)

FOREIGN PATENT DOCUMENTS

CN 1074524 A 7/1993
JP 49-89502 8/1974

(Continued)

*Primary Examiner* — Alissa Tompkins
*Assistant Examiner* — John Bargero
(74) *Attorney, Agent, or Firm* — Muncy, Geissler, Olds & lowe, P.C.

(57) ABSTRACT

There is provided a drain recovery system with which power for driving a feedwater pump can be reduced and the feedwater pump can be driven at low costs. The drain recovery system includes: a buffer tank; an assist tank disposed below the buffer tank; a first drain supply line that connects a load device and the buffer tank; a second drain supply line that connects the buffer tank and the assist tank; a drain supply valve; a communication line that establishes communication between the assist tank and the buffer tank; a communication valve; a steam supply line that supplies steam from a boiler to the assist tank; a steam supply valve; a feedwater line that supplies drain from the assist tank to the boiler; and a feedwater pump.

10 Claims, 3 Drawing Sheets

(51) Int. Cl.

| | |
|---|---|
| ***F22B 37/26*** | (2006.01) |
| ***F22D 5/00*** | (2006.01) |
| ***F22B 33/10*** | (2006.01) |
| ***F22B 35/00*** | (2006.01) |
| ***F01K 5/02*** | (2006.01) |

(52) U.S. Cl.
CPC ..... *F22B 37/26* (2013.01); *F22D 5/00* (2013.01); *Y10T 137/2937* (2015.04)

(58) Field of Classification Search
USPC ..... 122/451 R, 489; 137/156
See application file for complete search history.

(56) References Cited

U.S. PATENT DOCUMENTS 4,177,767 A * 12/1979 Regamey ..... F01K 9/023 122/1 R
5,918,570 A * 7/1999 Gilchrist ..... B01D 19/0047 122/451 R

FOREIGN PATENT DOCUMENTS

| | | |
|---|---|---|
| JP | 52-35362 | 8/1977 |
| JP | 60-165611 | 11/1985 |
| JP | 1-118006 A | 5/1989 |
| JP | H 0648083 B2 | 6/1994 |
| JP | 2006-105442 A | 4/2006 |

* cited by examiner

FIG. 3

| | | OPENING AND CLOSING STATE OF VALVES | | | | OPENING AND CLOSING STATE OF VALVES | | |
|---|---|---|---|---|---|---|---|---|
| | ASSIST TANK A | FIRST DRAIN SUPPLY VALVE (71A) | FIRST STEAM SUPPLY VALVE (72A) | FIRST COMMUNICATION VALVE (73A) | ASSIST TANK B | SECOND DRAIN SUPPLY VALVE (71B) | SECOND STEAM SUPPLY VALVE (72B) | SECOND COMMUNICATION VALVE (73B) |
| FIRST STEP | SUPPLY FEEDWATER TO BOILER | CLOSE | OPEN | CLOSE | SUPPLY DRAIN | OPEN | CLOSE | OPEN |
| SECOND STEP | SUPPLY FEEDWATER TO BOILER | CLOSE | OPEN | CLOSE | STANDBY | CLOSE | CLOSE | CLOSE |
| THIRD STEP | SUPPLY DRAIN | OPEN | CLOSE | OPEN | SUPPLY FEEDWATER TO BOILER | CLOSE | OPEN | CLOSE |
| FOURTH STEP | STANDBY | CLOSE | CLOSE | CLOSE | SUPPLY FEEDWATER TO BOILER | CLOSE | OPEN | CLOSE |

DRAINAGE COLLECTION SYSTEM

TECHNICAL FIELD

The present invention relates to a drain recovery system. More specifically, the present invention relates to a closed scheme drain recovery system that recovers drain discharged from a load device and supplies as feedwater to a boiler, without opening the drain to the atmosphere. This application claims priority on Japanese Patent Application No. 2011-274131 filed on Dec. 15, 2011, the contents of which are hereby incorporated by reference.

BACKGROUND ART

Conventionally, there has been proposed a drain recovery system that supplies steam generated at a boiler to a load device, and that recovers drain generated from the steam having used as a heat source at the load device, to reuse the drain as feedwater to the boiler.

As the drain recovery system, there has been known an open scheme drain recovery system that recovers drain generated at a load device to an open type drain recovery tank opened to the atmosphere and that supplies the drain to a boiler, and a closed scheme drain recovery system that recovers drain of high temperature and high pressure to a pressure-resistant sealing drain recovery tank and that supplies the drain as feedwater to a boiler (for example, see Patent Literature 1).

DISCLOSURE OF THE INVENTION

Problems to be Solved by the Invention

The closed scheme drain recovery system can supply feedwater at higher temperatures as compared to the open scheme drain recovery system. Therefore, the fuel consumption of the boiler can be reduced, and driving costs of the boiler can be reduced. Further, the pressure difference between the drain recovery tank and the boiler can be reduced by maintaining the pressure inside the drain recovery tank at high pressures. Therefore, power for driving a feedwater pump, which is used for supplying feedwater from the drain recovery tank to the boiler, can be reduced.

Meanwhile, in connection with the drain recovery system, in order to discharge drain from a load device to the drain recovery tank, the pressure inside the drain recovery tank must be maintained to be lower than the pressure inside the load device. Further, in the load device, since steam is used for heat exchange, the temperature of the steam in the load device becomes lower than the temperature of the steam generated at the boiler, and the pressure inside the load device becomes lower than the pressure of the boiler.

Therefore, with the conventional closed scheme drain recovery system, feedwater cannot be supplied to the boiler in the state where the pressure inside the drain recovery tank is fully raised, and power for driving the feedwater pump cannot be fully reduced.

Accordingly, an object of the present invention is to provide a drain recovery system with which power for driving a feedwater pump can be reduced and the feedwater pump can be driven at low costs.

Means for Solving the Problems

The present invention relates to a drain recovery system that recovers drain being generated by condensation of steam having been generated at a boiler and used at a load device and that supplies the drain to the boiler, the drain recovery system including: a buffer tank that stores the drain generated at the load device; an assist tank that is disposed below the buffer tank; a first drain supply line that connects the load device and the buffer tank to each other to supply the drain generated at the load device to the buffer tank; a second drain supply line that connects the buffer tank and the assist tank to each other to supply the drain stored in the buffer tank to the assist tank; a drain supply valve that opens and closes the second drain supply line; a communication line that connects the assist tank and the buffer tank to each other to establish communication between an inner space of the assist tank and an inner space of the buffer tank; a communication valve that opens and closes the communication line; a steam supply line that connects the boiler and the assist tank to each other to supply the steam generated at the boiler to the assist tank; a steam supply valve that opens and closes the steam supply line; a feedwater line that connects the assist tank and the boiler to each other to supply the drain stored in the assist tank to the boiler; and a feedwater pump that is disposed at the feedwater line.

Further, preferably, the drain recovery system further includes: a water level sensing unit that is provided to the assist tank to sense a water level of the drain stored in the assist tank; and a control unit that controls the drain supply valve, the steam supply valve, and the communication valve based on the water level sensed by the water level sensing unit. The control unit closes the steam supply valve and opens the communication valve and the drain supply valve when the water level sensed by the water level sensing unit is lower than a first water level. The control unit closes the communication valve and the drain supply valve when the water level sensed by the water level sensing unit is higher than a second water level that is higher than the first water level.

Still further, preferably, the drain recovery system includes a plurality of the assist tanks.

Still further, preferably, the assist tank is disposed above the boiler.

Still further, preferably, the drain recovery system further includes a makeup water supply line that supplies makeup water to the buffer tank.

Still further, preferably, the assist tank includes: a cylindrical tank body that is disposed such that a height direction thereof is aligned with a vertical direction; a steam inlet that is provided at a top face of the tank body, the steam supply line being connected to the steam inlet; and a plate-like member that is disposed below the steam inlet inside the tank body so as to spread in a horizontal direction.

Still further, preferably, the tank body is formed into a cylindrical shape in which a height is greater than a diameter.

Still further, preferably, the boiler includes a plurality of boiler bodies that generate the steam, and a steam header into which the steam generated by the plurality of boiler bodies is gathered, and the steam supply line is connected to the steam header.

Still further, the present invention relates to an operation method of any one of the drain recovery systems described above including: closing the steam supply valve and the drain supply valve and opening the communication valve to equalize a pressure inside the assist tank and a pressure inside the buffer tank with each other; in a state where the pressure inside the assist tank and the pressure inside the buffer tank are equalized with each other, opening the drain supply valve to supply the drain stored in the buffer tank to the assist tank; after the drain is supplied to the assist tank, closing the communication valve and the drain supply valve; after the communication valve and the drain supply valve are closed, opening the steam supply valve to supply the steam to the assist tank and increase the pressure inside the assist tank; and in a state where the pressure inside the assist tank is increased, supplying the drain from the assist tank to the boiler.

Further, preferably, in increasing the pressure inside the assist tank, the pressure inside the assist tank is increased so as to be substantially equalized with a pressure of the boiler.

Effects of the Invention

With the drain recovery system of the present invention, power for driving a feedwater pump can further be reduced, and the feedwater pump can be driven at low costs.

BRIEF DESCRIPTION OF THE DRAWINGS

FIG. 3 is an explanatory diagram showing the opening and closing states of valves in the drain recovery system according to the present embodiment.

EXPLANATION OF REFERENCE NUMERALS

Figure 1:
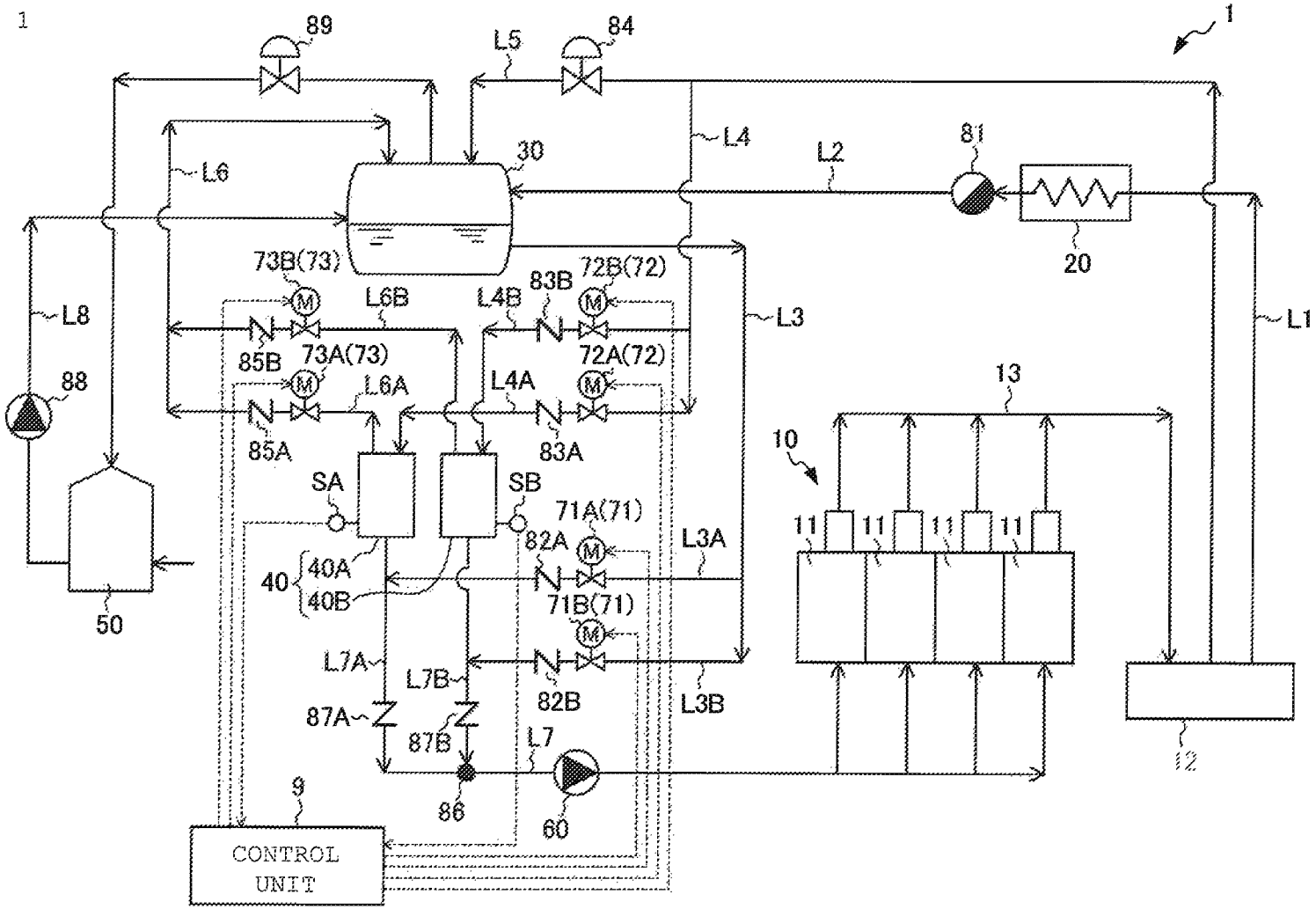
FIG. 1 is a diagram showing the structure of a drain recovery system according to one embodiment of the present invention.

1 drain recovery system
9 control unit
10 boiler
11 boiler body
12 steam header
20 load device
30 buffer tank
40 assist tank
41 tank body
42 steam inlet
43 plate-like member
60 drain pump (feedwater pump)
71 drain supply valve
72 steam supply valve
73 communication valve
L2 first drain supply line
L3 second drain supply line
L4 second steam supply line (steam supply line)
L7 feedwater line
L8 makeup water supply line
SA, SB water level sensor (water level sensing unit)

PREFERRED MODE FOR CARRYING OUT THE INVENTION

In the following, with reference to the drawings, a description will be given of a drain recovery system according to an embodiment of the present invention. The drain recovery system according to the present embodiment is a closed scheme drain recovery system that recovers drain of high temperature and high pressure generated at a load device to be stored in a pressure-resistant sealing tank, which drain is supplied as feedwater to a boiler.

Firstly, with reference to FIG. 1, a description 11 be given of an overall structure of a drain recovery system 1 according to the present embodiment. In the following description, the "lines" collectively refers to flow channels, routes, pipe paths and the like.

The drain recovery system 1 according to the present embodiment includes a boiler 10, a load device 20, a buffer tank 30, an assist tank 40, an open tank 50, and a drain pump 60 as a feedwater pump.

Further, the drain recovery system 1 includes a plurality of lines that connect these devices and through which steam or water communicates, a plurality of valves that open and close the plurality of lines, and a control unit 9 that controls the operations of the plurality of valves. Specifically, the drain recovery system 1 includes, as the lines, a first steam supply line L1, a first drain supply line L2, a second drain supply line L3, a second steam supply line L4 as a steam supply line of the present invention, a third steam supply line L5, a communication line L6, a feedwater line L7, a makeup water supply line L8, and a flash steam discharge line L9. Further, the drain recovery system 1 includes, as valves, a drain supply valve 71, a steam supply valve 72, and a communication valve 73.

The boiler 10 includes a plurality of boiler bodies 11 that generate steam, a steam header 12 into which the steam generated at the plurality of boiler bodies 11 is gathered, and a coupling pipe 13 that couples the plurality of boiler bodies 11 and the steam header 12 to each other.

The plurality of boiler bodies 11 heat water supplied to the boiler bodies 11 to generate steam. The steam generated at the plurality of boiler bodies 11 is supplied to the steam header 12 through the coupling pipe 13.

The load device 20 carries out heat exchange with a heating target object, using the steam generated at the boiler 10 as the heat source.

The buffer tank 30 collects and stores drain that is produced by condensation of part of the steam having used for heat exchange at the load device 20. The buffer tank 30 is a pressure-resistant sealable pressure vessel. The buffer tank 30 is disposed above the boiler 10.

The assist tank 40 is disposed downstream from the buffer tank 30. This assist tank 40 is disposed below the buffer tank 30 and above the boiler 10. The assist tank 40 stores the drain supplied from the buffer tank 30. The drain stored in the assist tank 40 is supplied to the boiler 10.

In the present embodiment, the assist tank 40 includes two tanks, namely a first assist tank 40A and a second assist tank 40B. To the first assist tank 40A and the second assist tank 40B, water level sensors SA and SB as water level sensing units that sense the water level of the stored drain are attached, respectively.

Figure 2:
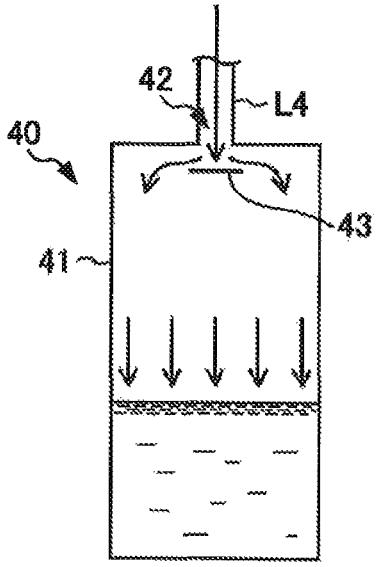
FIG. 2 is a schematic diagram showing an assist tank according to the present embodiment.

The assist tank 40 is a pressure-resistant sealable pressure vessel. More specifically, as shown in FIG. 2, the assist tank 40 includes a tank body 41, a steam inlet 42 provided to the tank body 41, and a plate-like member 43 that is disposed inside the tank body 41.

The tank body 41 is formed into a cylindrical shape, and disposed such that its height direction is aligned with the vertical direction. The tank body 41 is formed into a vertically elongated cylindrical shape, with the height being greater than the diameter.

The steam inlet 42 is provided at the center of the top face of the tank body 41. To the steam inlet 42, the downstream end of the second steam supply line L4, which will be described later, is connected. Steam supplied from the second steam supply line L4 is introduced downward from the steam inlet 42 into the tank body 41.

The plate-like member 43 is formed into a disk shape whose diameter is smaller than that of the tank body 41. The plate-like member 43 is disposed below the steam inlet 42 to spread in the horizontal direction. The plate-like member 43 functions as a straightening vane that rectifies the steam introduced from the steam inlet 42 into the tank body 41. The plate-like member 43 is, for example, suspended by a suspension member (not shown) provided to the inner face of the top face of the tank body 41, to be disposed below the steam inlet 42.

The open tank 50 is opened to the atmosphere. The open tank 50 stores makeup water supplied to the boiler 10 via the buffer tank 30 and the assist tank 40. Further, into the open tank 50, flash steam generated from the drain at the buffer tank 30 is introduced.

The drain pump 60 is disposed at the feedwater line L7, which will be described later. The drain pump 60 raises the pressure of the drain supplied from the assist tank 40 and supplies the drain to the boiler 10.

The first steam supply line L1 connects the steam header 12 and the load device 20 to each other, and supplies steam generated at the boiler 10 to the load device 20.

The first drain supply line L2 connects the load device 20 and the buffer tank 30 to each other, and supplies drain generated at the load device 20 to the buffer tank 30. To the first drain supply line L2, a steam trap 81 that discharges the drain generated at the load device 20 and that prevents steam from being discharged.

The second drain supply line L3 connects the buffer tank 30 and the assist tank 40 to each other, and supplies the drain stored in the buffer tank 30 to the assist tank 40. In the present embodiment, the upstream end of the second drain supply line L3 is connected to the lower part of the buffer tank 30. Further, the downstream side of the second drain supply line L3 is branched into a second drain supply line L3A that supplies the drain to the first assist tank 40A, and a second drain supply line L3B that supplies the drain to the second assist tank 40B. Then, the downstream end of the second drain supply line L3A is connected to the bottom part of the first assist tank 40A, and the downstream end of the second drain supply line L3B is connected to the bottom part of the second assist tank 40B.

The drain supply valve 71 is a motor valve, and disposed at the second drain supply line L3. In the present embodiment, as the drain supply valve 71, a first drain supply valve 71A is disposed at the second drain supply line L3A, and a second drain supply valve 71B is disposed at the second drain supply line L3B. Further, on the downstream side of the first drain supply valve 71A at the second drain supply line L3A and on the downstream side of the second drain supply valve 71B at the second drain supply line L3B, check valves 82A and 82B for preventing the drain from reversely flowing from the assist tank 40 to the buffer tank 30 are provided.

The second steam supply line L4 connects the steam header 12 and the assist tank 40 to each other, and supplies the steam generated at the boiler 10 to the assist tank 40. In the present embodiment, the downstream side of the second steam supply line L4 is branched into a second steam supply line L4A that supplies steam to the first assist tank 40A, and a second steam supply line L4B that supplies steam to the second assist tank 40B. Then, the downstream end of the second steam supply line L4A is connected to the upper part of the first assist tank 40A, and the downstream end of the second steam supply line L4B is connected to the upper part of the second assist tank 40B.

The steam supply valve 72 is a motor valve, and disposed at the second steam supply line L4. In the present embodiment, as the steam supply valve 72, a first steam supply valve 72A is disposed at the second steam supply line L4A, and a second steam supply valve 72B is disposed at the second steam supply line L4B. Further, on the downstream side of the first steam supply valve 72A at the second steam supply line L4A, and on the downstream side of the second steam supply valve 72B at the second steam supply line L4B, check valves 83A and 83B for preventing steam from reversely flowing from the assist tank 40 are disposed.

The third steam supply line L5 connects the steam header 12 and the buffer tank 30 to each other, and supplies steam generated at the boiler 10 to the buffer tank 30. In the present embodiment, the upstream side of the third steam supply line L5 is connected to a point upstream from the branching point between the second steam supply line L4A and the second steam supply line L4B at the second steam supply line L4. That is, in the embodiment, the upstream side of the second steam supply line L4 and the upstream side of the third steam supply line L5 are structured by a shared line. The downstream end of the third steam supply line L5 is connected to the upper part of the buffer tank 30. At the third steam supply line L5, a pressure adjusting valve 84 for supplying steam to the buffer tank 30 at a prescribed pressure is disposed.

The communication line L6 connects the assist tank 40 and the buffer tank 30 to each other, thereby establishing communication between the inner space of the assist tank 40 and the inner space of the buffer tank 30. In the present embodiment, the end of the communication line L6 on the buffer tank 30 side is connected to the upper part of the buffer tank 30. Then, the communication line L6 branches, on the assist tank 40 side, into a communication line L6A that is connected to the upper part of the first assist tank 40A and a communication line L63 that is connected to the upper part of the second assist tank 40B.

The communication valve 73 is a motor valve, and disposed at the communication line L6. In the present embodiment, as the communication valve 73, a first communication valve 73A is disposed at the communication line L6A, and a second communication valve 73B is disposed at the communication line L6B. Further, on the buffer tank 30 side of the first communication valve 73A at the communication line L6A and on the buffer tank 30 side of the second communication valve 73B at the communication line L6B, check valves 85A and 85B for preventing steam from reversely flowing from the buffer tank 30 to the assist tank 40 are provided.

The feedwater line L7 connects the assist tank 40 and the boiler 10 to each other, and supplies the drain stored in the assist tank 40 to the boiler 10. In the present embodiment, in connection with the feedwater line L7, a feedwater line L7A whose upstream end is connected to the first assist tank 40A and a feedwater line L7B whose upstream end is connected to the second assist tank 40B are connected to each other at a connection portion 86 so as to be merged with each other. The drain pump 60 described above is disposed on the downstream side of the connection portion 86 at the feedwater line L7.

The feedwater line L7 is divided into branches as many as the plurality of boiler bodies 11 on the downstream side of the connection portion 86, and the ends of the branches of the line are respectively connected to the plurality of boiler bodies 11.

In the present embodiment, to the feedwater line L7A and the feedwater line L7B, check valves 87A and 87B for preventing water from reversely flowing from the boiler 10 are disposed. Further, the feedwater line L7A located upstream from the check valve 87A and the feedwater line L7B located upstream from the check valve 87B are structured by lines shared with the downstream side of the second drain supply line L3A and the downstream side of the second drain supply line L3B.

The makeup water supply line L8 connects the open tank 50 and the buffer tank 30 to each other, and supplies makeup water stored in the open tank 50 to the buffer tank 30. At the makeup water supply line L8, a makeup water supply pump 88 is disposed. By allowing the makeup water supply pump 88 to drive, the makeup water is supplied from the open tank 50 to the buffer tank 30.

The flash steam discharge line L9 connects the buffer tank 30 and the open tank 50 to each other, and discharges flash steam generated at the buffer tank 30 to the open tank 50. At this flash steam discharge line L9, a pressure adjusting valve 89 is disposed. When the pressure inside the buffer tank 30 becomes higher than a prescribed pressure, the pressure adjusting valve 89 releases the flash steam toward the open tank 50, thereby reducing the pressure inside the buffer tank 30.

The control unit 9 controls opening and closing and the like of the drain supply valve 71, the steam supply valve 72, and the communication valve 73, based on signals from the boiler 10 and the water level sensed by the water level sensors SA and SB. Details of the control exerted by the control unit 9 on the valves will be described later.

In the drain recovery system 1 according to the present embodiment, drain generated at the load device 20 is stored in the buffer tank 30 via the first drain supply line L2. The drain stored in the buffer tank 30 is supplied to the first assist tank 40A or the second assist tank 40B via the second drain supply line L3. Then, the drain is supplied from one of the first assist tank 40A and the second assist tank 40B to the boiler 10 via the feedwater line L7.

Here, in the present embodiment, since the assist tank 40 is provided below the buffer tank 30, and the communication line L6 that establishes communication between the inner space of the assist tank 40 and the inner space of the buffer tank 30 is provided, drain can be supplied from the buffer tank 30 to the assist tank 40 without the necessity of power of a pump or the like.

Further, since the assist tank 40 is provided with the second steam supply line L4 that supplies steam, the pressure inside the assist tank 40 can be raised to a pressure substantially identical to the pressure of the boiler 10. Thus, since a feedwater supply to the boiler 10 can be provided in the state where the power for driving the drain pump 60 is reduced, the drain recovery system 1 can be driven at low costs.

Still further, since the assist tank 40 is disposed above the boiler 10, the height difference between the assist tank 40 and the boiler 10 also can be used for supplying feedwater from the assist tank 40 to the boiler 10. Thus, power for driving the drain pump 60 can be further reduced.

Still further, the assist tank 40 is structured to include the tank body 41 and the plate-like member 43, and the plate-like member 43 is disposed below the steam inlet 42 inside the tank body 41. Thus, the steam introduced from the steam inlet 42 downward can be rectified by the plate-like member 43. Accordingly, the steam can be evenly introduced into the tank body 41 without creation of biased flow in the tank body 41. Hence, since the surface of drain stored in the tank body 41 is not disturbed by the introduced steam, heat exchange at the interface between the drain and the steam can be suppressed. As a result, the pressure inside the assist tank 40 can be raised in short time. Further, since the amount of the steam supplied to the assist tank 40 can be made smaller, the energy saving effect can be improved.

Still further, the tank body 41 is formed into a vertically elongated cylindrical shape. Thus, the area of the interface between the drain and the steam in the tank body 41 can be reduced. Hence, since the area of the interface where the saturation state of the steam should be maintained can be reduced, the pressure inside the assist tank 40 can be raised in short time. Further, since the amount of the steam supplied to the assist tank 40 can be reduced, the energy saving effect can be improved.

Still further, the upstream end of the second steam supply line L4 and third steam supply line L5 is connected to the steam header 12. Thus, from the steam header 12 in which steam generated from the plurality of boiler bodies 11 is gathered, steam can be supplied to the buffer tank 30 and the assist tank 40. Accordingly, variations in the pressure of each of the plurality of boiler bodies 11 can be reduced, which variations may occur in the case where steam is used in the buffer tank 30 and the assist tank 40.

Still further, since the assist tank 40 is structured by two tanks, namely the first assist tank 40A and the second assist tank 40B, feedwater can be continuously supplied to the boiler 10.

Next, a description will be given of a specific operation of the drain recovery system 1 according to the present embodiment.

A supply of drain to the boiler 10 in the drain recovery system 1 can be realized chiefly by allowing the first drain supply valve 71A, the second drain supply valve 71B, the first steam supply valve 72A, the second steam supply valve 72B, the first communication valve 73A, and the second communication valve 73B to open and close in the following procedure, which is shown in FIG. 3.

FIG. 3 is a diagram showing the opening and closing states of the first drain supply valve 71A, the second drain supply valve 71B, the first steam supply valve 72A, the second steam supply valve 72B, the first communication valve 73A, and the second communication valve 73B in the steps when the boiler 10 is continuously supplied with feedwater by the drain recovery system 1.

With reference to FIG. 3, a description will be given of the case in which a feedwater supply to the boiler 10 is started in the state where the water level of the first assist tank 40A is in the full level state (the state where the water level is higher than a second water level, which will be described later), and where the water level of the second assist tank 40B has dropped (the state where the water level is lower than a first water level, which will be described later). In this case, as shown in FIG. 3, the valves are opened and closed in order of the first step, the second step, the third step, and the fourth step. The first to fourth steps are repeated. Note that, while feedwater is supplied to the boiler 10, the drain pump 60 is continuously driven.

In the first step, feedwater is supplied from the first assist tank 40A to the boiler 10, and the second assist tank 40B is supplied with drain.

In this case, as shown in FIG. 3, firstly, the first steam supply valve 72A is opened, and steam is supplied to the first assist tank 40A. Then, the pressure inside the first assist tank 40A is raised and when the difference between the pressure inside the first assist tank 40A and the pressure of the boiler 10 becomes smaller than a prescribed value (for example, 0.2 MPa), by the drive force of the drain pump 60, supply of drain from the first assist tank 40A to the boiler 10 is started. Note that, in this state, the first drain supply valve 71A and the first communication valve 73A are closed.

Note that, in this first step, the water level sensed by the water level sensor SB is lower than the first water level, which is the water level indicating that the remaining amount of drain stored in the second assist tank 40B is small. When the water level sensed by the water level sensor SB becomes lower than the first water level, the control unit 9 opens the second communication valve 73B and the second drain supply valve 71B. Then, when the second communication valve 73B is opened, the inner space of the second assist tank 40B and the inner space of the buffer tank 30 communicate with each other, whereby the pressure inside the second assist tank 40B and the pressure inside the buffer tank 30 become identical to each other. Here, the buffer tank 30 is disposed above the second assist tank 40B. Thus, by the height difference between the buffer tank 30 and the second assist tank 40B, the second assist tank 40B is supplied with drain from the buffer tank 30.

In the second step, in the state where the feedwater supply from the first assist tank 40A to the boiler 10 is being carried out, the supply of drain to the second assist tank 40B is completed. Then, the second assist tank 40B enters the standby state.

In the second step, the state where the first steam supply valve 72A is opened and the first drain supply valve 71A and the first communication valve 73A are closed is maintained, while the feedwater supply from the first assist tank 40A to the boiler 10 is continued. Then, the water level of the drain stored in the first assist tank 40A is gradually reduced.

On the other hand, when the water level of the second assist tank 40B rises to the second water level, which is higher than the first water level and which is indicative of the full level state of the second assist tank 40B, the water level sensor SB senses that the water level of the second assist tank 40B has become higher than the second water level. When the water level sensor SE senses that the water level of the second assist tank 40B has become higher than the second water level, the control unit 9 closes the second drain supply valve 71B and the second communication valve 73B. Thus, the second assist tank 40B enters the standby state where preparation for a feedwater supply to the boiler 10 is completed.

In the third step, the water level of the first assist tank 40A has dropped, and the feedwater supply from the first assist tank 40A to the boiler 10 is stopped. Further, the feedwater supply from the second assist tank 40B to the boiler 10 is started, and the first assist tank 40A is supplied with drain from the buffer tank 30.

In this third step, when the water level of the first assist tank 40A has dropped to the prescribed first water level, the water level sensor SA senses that the water level of the first assist tank 40A has become lower than the first water level. When the water level sensor SA senses that the water level of the first assist tank 40A has become lower than the first water level, the control unit 9 closes the first steam supply valve 72A. Then, the supply of steam to the first assist tank 40A is stopped, whereby the pressure inside the first assist tank 40A is reduced. Then, when the pressure difference between the pressure inside the first assist tank 40A and the pressure of the boiler becomes higher than a prescribed value (for example, 0.2 MPa), the supply of steam from the first assist tank 40A to the boiler 10 is stopped.

Further, in the third step, after the control unit 9 closes the first steam supply valve 72A, or simultaneously with the closure of the first steam supply valve 72A, the control unit 9 opens the first communication valve 73A and the first drain supply valve 71A. Further, by the inner space of the first assist tank 40A and the inner space of the buffer tank 30 communicating each other, high-pressure steam inside the first assist tank 40A flows into the buffer tank 30, whereby the pressure inside the first assist tank 40A and the pressure inside the buffer tank 30 become identical to each other. Thus, by the height difference between the buffer tank 30 and the first assist tank 40A, the first assist tank 40A is supplied with drain from the buffer tank 30.

Note that, in the present embodiment, the check valve 82A is disposed at the second drain supply line L3A. Accordingly, even in the case where both the first communication valve 73A and the first drain supply valve 71A are simultaneously opened, reverse flow of the drain from the second drain supply line L3A to the buffer tank 30 can be prevented.

On the other hand, when the water level sensor SA of the first assist tank 40A senses that the water level of the first assist tank 40A has become lower than the first water level, the control unit 9 opens the second steam supply valve 72B. Then, steam is supplied to the second assist tank 40B, whereby the pressure inside the second assist tank 40B is raised. Then, when the difference between the pressure inside the second assist tank 40B and the pressure of the boiler 10 becomes smaller than a prescribed value (for example, 0.2 MPa), a supply of drain from the second assist tank 40B to the boiler 10 is started by the driving force of the drain pump 60.

Note that, in the third step, when the low water level state of the first assist tank 40A is sensed by the water level sensor SA, the control unit 9 may firstly open the second steam supply valve 72B, and then close the first steam supply valve 72A after a lapse of a prescribed time (for example, one to two seconds). Thus, before a feedwater supply from the first assist tank 40A to the boiler 10 stops, a feedwater supply from the second assist tank 40B to the boiler 10 can be started. Therefore, the feedwater supply to the boiler 10 can be continuously carried out more surely.

In the fourth step, in the state where the feedwater supply from the second assist tank 40B to the boiler 10 is being carried out, the supply of drain to the first assist tank 40A is completed, and the first assist tank 40A enters the standby state.

In the fourth step, the state where the second steam supply valve 72B is opened and the second drain supply valve 71B and the second communication valve 73B are closed is maintained, and the feedwater supply from the second assist tank 40B to the boiler 10 is maintained.

On the other hand, when the water level of the first assist tank 40A rises to the second water level, the water level sensor SA senses that the water level of the first assist tank 40A has become higher than the second water level. When the water level sensor SA senses that the water level of the first assist tank 40A has become higher than the second water level, the control unit 9 closes the first drain supply valve 71A and the first communication valve 73A. Thus, the first assist tank 40A enters the standby state where preparation for a feedwater supply to the boiler 10 is completed.

While the feedwater supply to the boiler 10 continues, the first to fourth steps are repeated.

With the drain recovery system 1, while a feedwater supply from the first assist tank 40A to the boiler 10 is being carried out, the second assist tank 40B is supplied with drain from the buffer tank 30 to enter the full level state. When the water level of the first assist tank 40A has dropped, while a feedwater supply is being carried out from the second assist tank 40B to the boiler 10, drain can be supplied from the buffer tank 30 to the first assist tank 40A. Thus, a continuous feedwater supply to the boiler 10 required by the boiler 10 made of a plurality of boiler bodies 11 can be realized.

Further, the drain recovery system 1 is structured to include the water level sensor S provided to the assist tank 40 and the control unit 9 that closes the steam supply valve 72 and opens the communication valve 73 and the drain supply valve 71 when the water level sensed by the water level sensor S has become lower than the first water level and that closes the communication valve 73 and the drain supply valve 71 when the water level sensed by the water level sensor S has become higher than the second water level. Thus, when the water level of the assist tank 40 has dropped, the pressure inside the assist tank 40 and the pressure inside the buffer tank 30 can be equalized with each other by opening the communication valve 73. Further, by opening the drain supply valve 71 in this state, drain can be supplied from the buffer tank 30 to the assist tank 40 using the height difference between the buffer tank 30 and the assist tank 40. Further, when the water level of the assist tank 40 has risen, by closing the communication valve 73 and the drain supply valve 71, the assist tank 40 can enter the standby state where preparation of a feedwater supply to the boiler 10 is completed.

In the foregoing, though the description has been given of the drain recovery system according to one preferred embodiment of the present invention, the present invention is not limited to the embodiment described above, and can be changed as appropriate.

For example, in the present embodiment, though the upstream side of the second steam supply line L4 and third steam supply line L5 is connected to the steam header 12, the present invention is not limited thereto. That is, the upstream side of the second steam supply line and third steam supply line may be connected to any of the plurality of boiler bodies.

Further, in the present embodiment, though the drain recovery system 1 is structured to include two assist tanks 40, namely the first assist tank 40A and the second assist tank 40B, the present invention is not limited thereto. That is, the drain recovery system can be structured by one assist tank.

Still further, in the present embodiment, though the drain recovery system 1 is structured to include the third steam supply line L5 and the pressure adjusting valve 84, the present invention is not limited thereto. That is, the drain recovery system may be structured without the third steam supply line L5 and the pressure adjusting valve 84.

The invention claimed is:

1. A drain recovery system that recovers drain being generated by condensation of steam having been generated at a boiler and used at a load device and that supplies the drain to the boiler, the drain recovery system comprising:

a buffer tank that stores the drain generated at the load device;

an assist tank that is disposed below the buffer tank;

a plate-like member, which is disposed below a steam inlet of the assist tank, configured to deflect the steam in a horizontal direction;

a first drain supply line that connects the load device and the buffer tank to each other to supply the drain generated at the load device to the buffer tank;

a second drain supply line that connects the buffer tank and the assist tank to each other configured to allow the drain stored in the buffer tank to flow out of the buffer tank and to flow into the assist tank;

a drain supply valve that opens and closes the second drain supply line;

a communication line that connects the assist tank and the buffer tank to each other to establish communication between an inner space of the assist tank and an inner space of the buffer tank;

a communication valve that opens and closes the communication line;

a steam supply line that connects the boiler and the assist tank to each other to supply the steam generated at the boiler to the assist tank;

a steam supply valve that opens and closes the steam supply line;

a feedwater line that connects the assist tank and the boiler to each other to supply the drain stored in the assist tank to the boiler; and a feedwater pump that is disposed at the feedwater line, wherein a downstream end of the second drain supply line is connected to a bottom part of the assist tank, so that disturbance of a liquid surface of the drain flowed into the assist tank is minimized and heat exchange at an interface between the steam and the drain in the assist tank is restrained.

2. The drain recovery system according to claim 1 further comprising:

a water level sensing unit that is provided to the assist tank to sense a water level of the drain stored in the assist tank; and a control unit that controls the drain supply valve, the steam supply valve, and the communication valve based on the water level sensed by the water level sensing unit, wherein the control unit closes the steam supply valve and opens the communication valve and the drain supply valve when the water level sensed by the water level sensing unit is lower than a first water level, and the control unit closes the communication valve and the drain supply valve when the water level sensed by the water level sensing unit is higher than a second water level that is higher than the first water level.

3. The drain recovery system according to claim 2 comprising a plurality of assist tanks.

4. The drain recovery system according to claim 1, wherein the assist tank is disposed above the boiler.

5. The drain recovery system according to claim 1 further comprising a makeup water supply line that supplies makeup water to the buffer tank.

6. The drain recovery system according to claim 1, wherein the assist tank includes:

a cylindrical tank body that is disposed such that a height direction thereof is aligned with a vertical direction; and a steam inlet that is provided at a top face of the tank body, the steam supply line being connected to the steam inlet.

7. The drain recovery system according to claim 6, wherein the tank body is formed into a cylindrical shape in which a height is greater than a diameter.

8. The drain recovery system according to claim 1, wherein the boiler includes a plurality of boiler bodies that generate the steam, and a steam header into which the steam generated by the plurality of boiler bodies is gathered, and the steam supply line is connected to the steam header.

9. An operation method of the drain recovery system according to claim 1 comprising:

closing the steam supply valve and the drain supply valve and opening the communication valve to equalize a pressure inside the assist tank and a pressure inside the buffer tank with each other;

in a state where the pressure inside the assist tank and the pressure inside the buffer tank are equalized with each other, opening the drain supply valve to supply the drain stored in the buffer tank to the assist tank;

after the drain is supplied to the assist tank, closing the communication valve and the drain supply valve;

after the communication valve and the drain supply valve are closed, opening the steam supply valve to supply the steam to the assist tank and increase the pressure inside the assist tank; and in a state where the pressure inside the assist tank is increased, supplying the drain from the assist tank to the boiler.

10. The operation method of the drain recovery system according to claim 9, wherein in increasing the pressure inside the assist tank, the pressure inside the assist tank is increased so as to be substantially equalized with a pressure of the boiler.

* * * * *